US006329743B1

(12) United States Patent
Camilli

(10) Patent No.: US 6,329,743 B1
(45) Date of Patent: Dec. 11, 2001

(54) CURRENT PEAKING SPARKPLUG

(76) Inventor: Louis S. Camilli, 8280 Bob-O-Link Dr., West Palm Beach, FL (US) 33412

( * ) Notice: Subject to any disclaimer, the term of this patent is extended or adjusted under 35 U.S.C. 154(b) by 0 days.

(21) Appl. No.: 09/376,150

(22) Filed: Aug. 17, 1999

(51) Int. Cl.[7] ..... H01T 13/22; H01T 13/34

(52) U.S. Cl. ..... 313/141; 313/135; 315/58; 315/59

(58) Field of Search ..... 313/124, 135, 313/136, 137, 138, 141; 315/58, 59; 123/596

(56) References Cited

U.S. PATENT DOCUMENTS

| | | | | |
|---|---|---|---|---|
| 1,148,106 | | 7/1915 | Lux . | |
| 3,683,232 | | 8/1972 | Baur | 315/58 |
| 4,549,114 | * | 10/1985 | Herden | 315/58 |
| 4,751,430 | | 6/1988 | Muller et al. . | |
| 5,103,136 | * | 4/1992 | Sezuki et al. | 315/59 |
| 5,272,415 | | 12/1993 | Griswold et al. | 315/58 |
| 5,371,436 | * | 12/1994 | Griswold | 315/58 |
| 5,705,892 | * | 1/1998 | Codina et al. | 315/58 |

* cited by examiner

*Primary Examiner*—Michael H. Day
(74) *Attorney, Agent, or Firm*—John R. Lansdowne

(57) ABSTRACT

A sparkplug having multiple side discharge negative electrodes and employing an integral capacitor extending from the plug body to the area of the connector to the ignition system to effectively store the electrical energy normally lost during the rise time of the ignition transformer, and to discharge the stored energy across the electrode gap. The body (2) has a cylindrical extension which serves as the negative plate (10) of the capacitive element. A positive electrode (8) forms the interior portion of the sparkplug. One end of the positive electrode forms a spark gap (9) with two or more negative electrodes (7). The other end of the positive electrode (8) connects by means of a resistive connector (4) to a conventional high-voltage ignition cable. The positive electrode (8) serves as the positive plate of the capacitive element. A moldable dielectric material (11) completely fills the space between the positive and negative plates (8, 10) of the capacitive element for the length of the sparkplug, and also serves as the outer insulator of the spark plug.

34 Claims, 9 Drawing Sheets

CURRENT PEAKING SPARKPLUG

FIELD OF THE INVENTION

The present invention relates to sparkplugs and, specifically, to a sparkplug having multiple side-discharge negative electrodes and a body constructed to effectively absorb the electrical energy normally lost during the rise time of the ignition transformer, a method to store electrical energy, and a method to discharge the stored energy across the electrode gap during the first few nanoseconds of the spark event.

BACKGROUND OF THE INVENTION

There have been many and various attempts at creating an ignitor, more commonly described as a sparkplug, for combusting fuel in an internal combustion engine. Behind these ignitors, in the ignition circuit, have been many devices designed to increase the effectiveness of the ignitor. The attempts at creating a more efficient ignitor or increasing the effectiveness of the ignitor can be described as conventional sparkplugs with modifications to the electrodes and/or electrode spacing, capacitors/condensers in parallel with the ignition circuit, or devices interrupting the high voltage ignition pulse. While these attempts do effect, to some degree, the dynamics of the spark event, they are unnecessarily complex, costly, and inefficient.

U.S. Pat. No. 3,683,232, issued to Baur, discloses a sparkplug cap designed to increase the sparking power. The cap has internal capacitance of an unknown quantity. Without knowing the size of the capacitor, it is impossible to determine the increase of power, and it is very likely that a capacitor of high capacitance as claimed would, in fact, deplete the ignition voltage, precipitating a misfire and causing the engine to cease operation. It is very likely the Baur device requires an ignition system which is significantly higher in output energy than is commonly found on internal combustion engines.

U.S. Pat. No. 4,751,430, issued to Muller et al., discloses a sparkplug connector comprising a storage capacitor coaxial with an ignition transformer, which is fitted onto a sparkplug disposed deep in a spark plug hole. Such an arrangement, for the same reason as in Baur, can cause the engine to cease operation.

In U.S. Pat. No. 5,272,415, issued to Griswold et al., the method is different from Muller et al. and Baur, but the purpose of inserting a capacitor in parallel with the ignition circuit at the sparkplug raises the same concerns as Muller et al. and Baur, and causes a further problem of excess radio frequency interference (RFI). In vehicles manufactured in the 1990's, there is an increasing use of microprocessors to monitor and modify engine functions based on present conditions. These microprocessors are very sensitive to RFI emanations, and they will misfunction or fail as the frequency of a ringing capacitive discharge occurs in the same range as the operating frequency of the microprocessors.

U.S. Pat. No. 1,148,106, issued to Lux, discloses the addition of a condenser arranged in the positive electrode of a sparkplug in combination with multiple sparkplug gaps by which the resistance is diminished at the sparkplug gap, thereby obtaining improved operation of the sparkplug. The resistance of the sparkplug gap, whether single or multiple, is directly related to the pressure at the gap and the distance between the positive and negative electrodes of the sparkplug. In the case of multiple electrodes, it is dependent on the distance between the closest positive and negative electrode. A "silent" capacitive discharge between a pair of opposing electrodes effectively reduces the resistance between that pair of electrodes and the ignition spark is generated there rather than at a different pair where no ionization occurred. In Lux, the reduction of the resistance at a spark gap distant from the fuel mixture through a "silent" discharge forces the spark to occur at the "silent" pair of electrodes, which might or might not have fuel present to ignite. It is possible to ensure the proper operation of the spark while not igniting the fuel charge at all.

SUMMARY OF THE INVENTION

According to the present invention, an improved sparkplug with very low resistance and inductance is provided for use with internal combustion engines to initiate the combustion of the fuel mixture. The body of the sparkplug incorporates a capacitive element to effectively absorb the electrical energy normally lost during the rise time of the ignition transformer, to store such electrical energy, and to discharge the stored energy across the electrode gap during the first few nanoseconds of the spark event.

The sparkplug is comprised of an iron or steel body constructed so as to be threaded into conventional sparkplug holes, as found on cylinderheads of internal combustion engines. The body has a cylindrical extension which serves as the negative plate of the capacitive element. The body also provides for multiple negative electrodes. It is further comprised of a positive electrode which forms the interior portion of the sparkplug. One end of the positive electrode forms a spark channel with two or more negative electrodes in a plane perpendicular to the motion of the piston. The other end of the positive electrode connects by means of a resistive element to a high-voltage ignition cable of conventional design. The positive electrode also serves as the positive plate of the capacitive element. It is cylindrical, and it extends centrally through the body of the sparkplug within the negative plate of the capacitive element. The positive electrode receives the resistive element which connects the sparkplug to the ignition system. A moldable dielectric material completely fills the space between the positive and negative plates of the capacitive element for the length of the sparkplug.

The primary object of the invention is to provide a sparkplug with very low resistance and inductance and a properly configured and electrically sized capacitive means by which to peak the current of the electrical spark discharge.

Another object of the invention is to provide a sparkplug with a resistive element outside of the spark discharge circuit preventing the emanations of radio frequency interference and allowing for the use of very low resistance ignition cables.

Another object of the invention is to provide a sparkplug with a spark electrode configuration designed to expose the length of the spark channel to the top of the piston.

A further object of the invention is to provide a sparkplug with an electrode configuration by which the wearing away of the electrode material through the Coulomb Effect is diminished.

Still another object of the invention is to provide alternative sparkplug designs which are compact and require very little space above the cylinder head, while still maintaining the required capacitive element.

Still another object of the invention is to provide an alternate means by which to connect the high-voltage ignition cable to the sparkplug preventing the loss of energy due to the creation of corona and the unintentional creation of a spark between the cable and the body of the sparkplug.

Other objects and advantages of the present invention will become more apparent to those persons having ordinary skill in the art to which the present invention pertains from the following description taken in conjunction with the accompanying drawings.

BRIEF DESCRIPTION OF THE DRAWINGS

The accompanying drawings, which are incorporated in and form part of the specification, illustrate embodiments of the present invention and, together with the descriptions, serve to explain the principles of the invention.

DETAILED DESCRIPTION OF INVENTION

Figure 1:
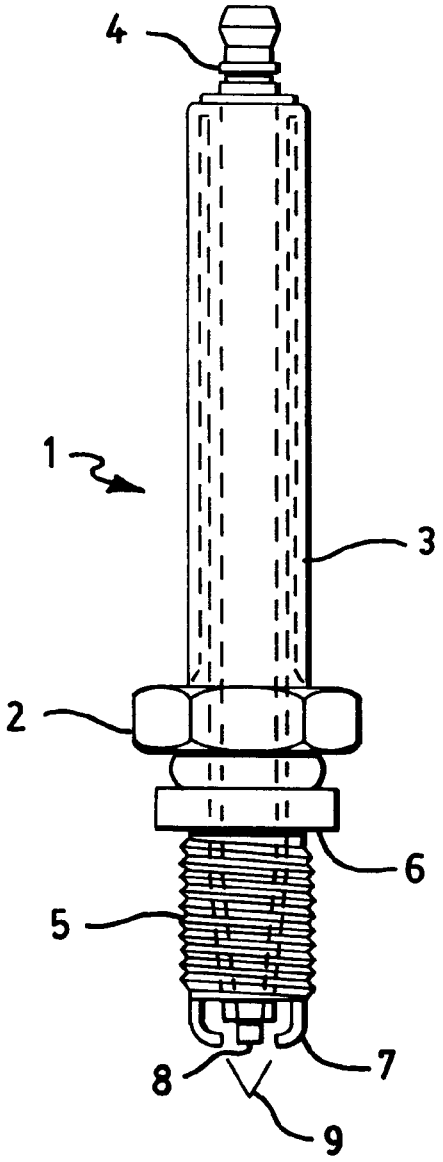
FIG. 1 shows a schematic diagram of a sparkplug in accordance with the present invention.

Referring now to the drawings, and more particularly to FIG. 1, a sparkplug 1 in accordance with the present invention is shown, which is longer than a sparkplug of conventional design. The body 2 of the sparkplug is conventional in design. It can be constructed of iron, steel, or other conductive material commonly used in sparkplugs. Installation hexes of 1", ⅞", 13⁄16", ¾", ⅝" and other common specifications may be utilized. The threaded portion and seat 6 are also conventional. The threads may be 18 mm, 14 mm, 12 mm, or 10 mm, and the seat may be either tapered- or washer-type. The insulator 3 can be of any suitable insulating material, such as ceramic, glass, or polymer, which provides high voltage insulation against the ignition pulse of up to 60 Kv. The resistive connector 4 is shown as a solid connector similar in shape to connectors found on conventional sparkplugs, but it can also be provided as a 4 mm threaded post. While similar in design to conventional connectors, the resistive connector of the present invention is different in material and in function as further discussed below.

The spark gap 9 is not conventional, as the spark channel is rotated to a position 90 degrees from the plane of the motion of the piston in the cylinder. Additionally, there are two or more negative electrodes 7, instead of the normal single negative electrode. This is necessary to reduce the loss of electrode material due to the Coulomb effect.

Figure 2:
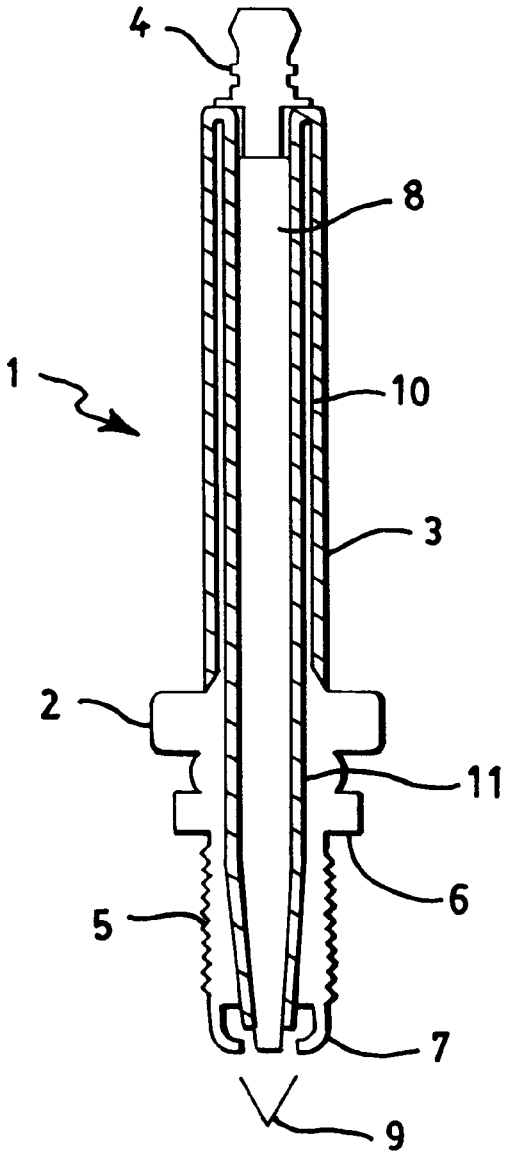
FIG. 2 shows a longitudinal cross section of such a sparkplug.

Referring now to FIG. 2, the capacitive element can be seen in axial cross section. The negative cylindrical plate 10 is an extension of the body 2. The positive cylindrical plate 8 is also the positive electrode. The dielectric insulation 11 is shown completely encasing the positive cylindrical plate 8, inside the negative cylindrical plate 10, except for where the center electrode is exposed at the spark gap 9.

The dielectric constant, Dc, of the dielectric insulation 11 is critical to the design of the sparkplug. The spacing between the negative plate 10 and the positive plate 8, in connection with the Dc of the insulating material and the length of the plates 10 and 8, determine the capacitance of the invention. The optimum capacitance for ignition systems as currently offered by automobile manufacturers is between 80 and 120 picofarads, which is a very small capacitance. The material chosen for the insulator will dictate the length of the extended portion of the body. The greater the dielectric constant, the shorter the length of the extended portion of the body. For example, preferably using a derivative of the Liquid Crystal Polymer family (LCP), which has a dielectric constant of 4.5, the capacitance of the invention can be predetermined by formula: Capacitance is equal to the product of a constant (1.4122) multiplied by the dielectric constant (Dc) of the material (4.5 in the case of LCP) divided by the natural log of the quotient of the inside diameter of the negative plate 10 divided by the outside diameter of the positive plate 8, multiplied by the length of the shortest plate. The values are calculated as follows to result in a capacitor of 80 picofarads:

$$Capacitance = \frac{(1.4122)\times(4.5)}{N\log.320/.250} = \frac{6.35490}{.24686} = 25.74292$$

The calculated result of 25.74292 is the capacitance per inch. If such a device is to have 80 picofarads of capacitance, the length of the shortest plate must be 3.11 inches in length. The selection of a material such as Kapton™, with a greater dielectric constant than LCP, will allow the extended portion of the body to be shorter in length. LCP and Kapton are also desirable dielectric materials as each can be molded to completely encase the positive cylindrical plate 8, inside the negative cylindrical plate 10. Many otherwise suitable dielectric materials lack such moldability.

In selecting a dielectric material, it is critical to consider not only the dielectric constant, but also dielectric strength, which is the ability of the material to withstand a specified voltage. This property of a material is stated in volts per mil (V/.001). For our selected dielectric material, LCP, the dielectric strength is 950 v/mil. With a spacing of 0.070" (70 mil), the total "voltage hold-off" of the material is 66.5 Kv, sufficient for an operating voltage of less than 20 Kv or a peak of less than 60 Kv.

The design of the capacitive element as discussed above reduces the inductance to almost zero and provides for the maximum delivery of stored energy in the shortest possible time. The frequency of the discharge and subsequent ringing is between 100 Mhz and 250 Mhz. In order to damp or eliminate the RFI associated with 250 Mhz emanations, a 2,000–5,000 ohm resistive connector 4 is permanently attached at the end of the positive cylindrical plate 8 connecting said plate to the high voltage cable of the ignition system. This resistive connector 4 can be of solid profile designed for snap on cable connectors, or can be of male threaded design, for example 4 mm X 0.7, as found on most European sparkplugs. The resistive connector can be constructed from various materials capable of providing the required resistance and being machined into the required shape. Carbon fiber materials are particularly suitable for such a purpose.

The center electrode 8 can be constructed as a solid bar of conductive material or of hollow drawn or formed construction. The center electrode must be of highly conductive material and, where exposed to the arc channel of the spark, it must be of solid construction. It is desirable to apply a highly conductive material, such as platinum, silver, or gold, to the tip of the center electrode and to the negative electrodes to enhance the field effect, promote more consistent spark breakdown, and reduce electrode wear due to the effect of electron transfer. Such techniques are well-known in the art.

It also is desirable to protect the portion of the dielectric insulation 11 protruding into the combustion chamber from exposure to heat in excess of 1,000 degrees Fahrenheit. Particularly desirable is to coat the dielectric insulation with a heat and flame resistant material, such as ceramic, to prevent destruction. Ceramic coating processes are well known in the sparkplug art. Without a protective coating, otherwise desirable dielectric materials will commonly char on the surface exposed to flame. Such degradation ultimately leads to failure of the device. An alternative to coating is to employ a ceramic cone, which is discussed below.

Figure 3A:
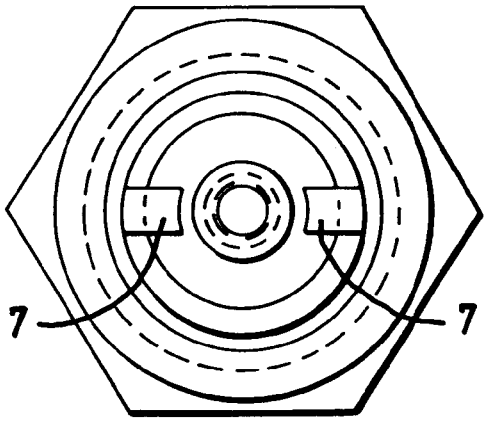
FIG. 3 shows an end view of the such a sparkplug and details of the electrode disposition.
Figure 3B:
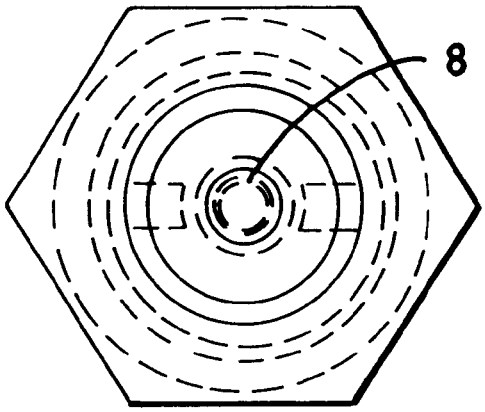

Referring now to FIG. 3, it can be seen that the negative electrodes 7 are, and must be, equidistant from the positive center electrode 8 and terminate in an arc equal to the arc created by the circumference of the center electrode. There could be any number of negative electrodes 7. However, a single electrode would experience excessive wear, which is reduced by the use of two or more electrodes.

Figure 4A:
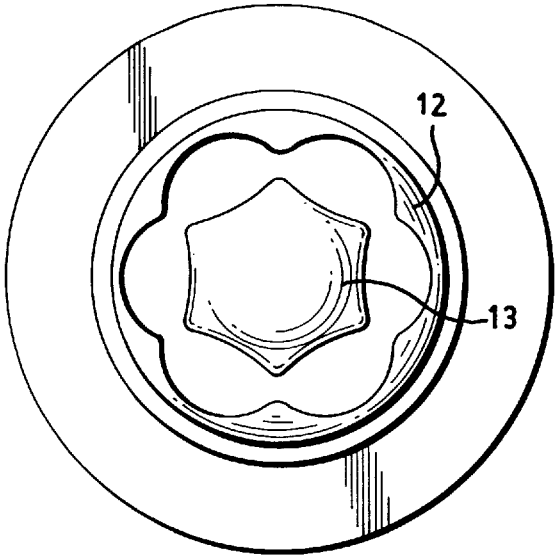
FIG. 4 shows the resistive connector of such a sparkplug.
Figure 4B:
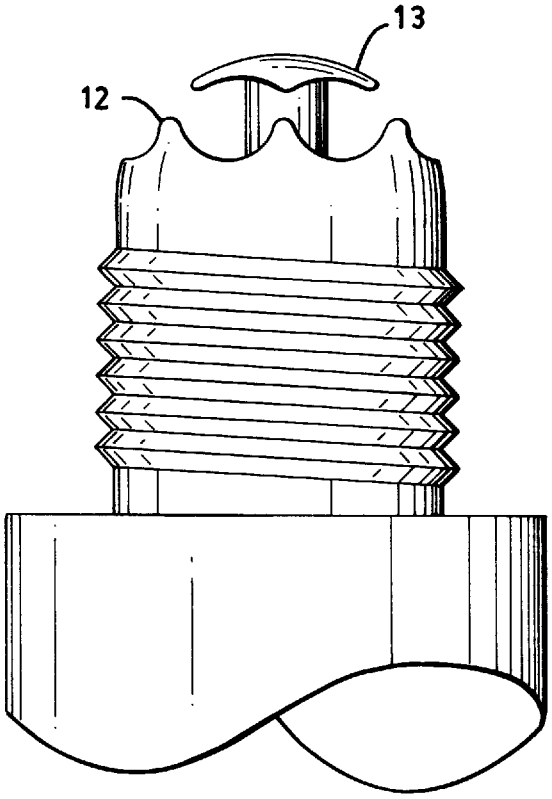

Referring now to FIG. 4, a particularly preferred deployment of multiple negative electrodes around the positive electrode is shown. Illustrated is a "crown" of negative electrodes 12 maintaining a consistent spark gap with the tips of a positive electrode extension in the shape of a "petal" 13. The distance between the positive and negative electrodes is adjusted by bending the negative electrode away from the positive electrode in order to conform to the automobile manufacturer specifications for spark gap spacing. This spacing is determined by the manufacturer of the engine and ignition systems conforming to the requirements for spark breakdown and ignition capability. It is not advisable to either increase or decrease the spacing from the specified factory setting.

Such a "crown" and "petal" arrangement of negative and positive electrodes provides a very stable field enhanced area for ionization to occur. The effects of heat induced ionization are reduced as are the effects of electrode wear, which would increase the voltage required for ionization. This electrode pattern will also reduce spark jitter, which are fluctuations of ionization voltages commonly found at idle in internal combustion engines. Any selected electrode pattern must provide smooth curves of the electrode tips for stable breakdown voltages in cylinders where the conditions are very inconsistent cycle-to-cycle, such as idle. The electrode pattern can be of any multiple from 2 to 10 or more individual arcing points.

Figure 5A:
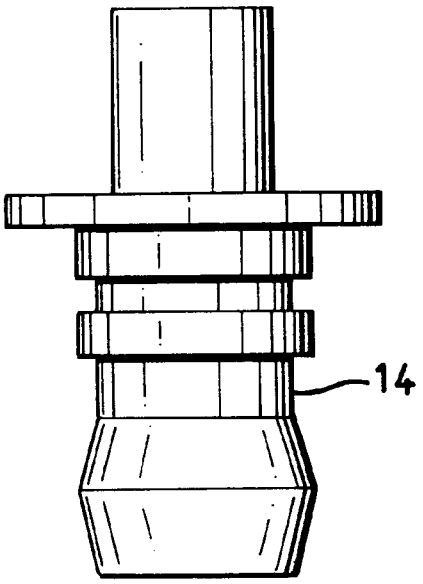
FIG. 5 shows the positive and negative electrodes in a crown arrangement.
Figure 5B:
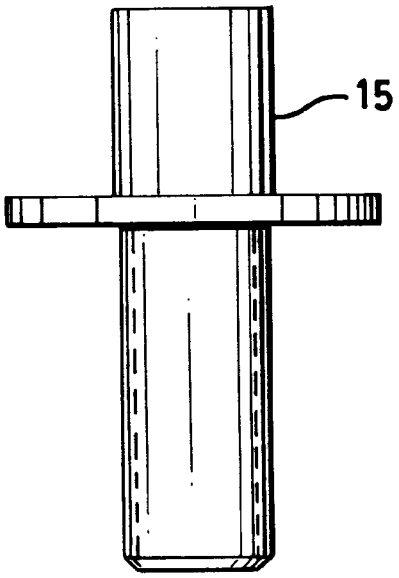

FIG. 5 illustrates the resistive connector 4 of the current invention in greater detail. It can be constructed of any suitable material providing the desired resistance, e.g., 5,000 ohms. The resistive component can be of any number of configurations to attach to the high voltage cable originating from the transformer. Shown are the two most common connector configurations in use for sparkplugs. One is a solid hourglass shape 14 intended for use on cables having a snap ring detent as commonly found on United States automobiles. The threaded configuration 15 is more commonly found on European automobiles. A resistive connector in accordance with the present invention may be produced in either configuration to provide the required resistance to effectively shunt the RFI emanating from the discharge "ringdown" cycle of the current invention.

Figure 6:
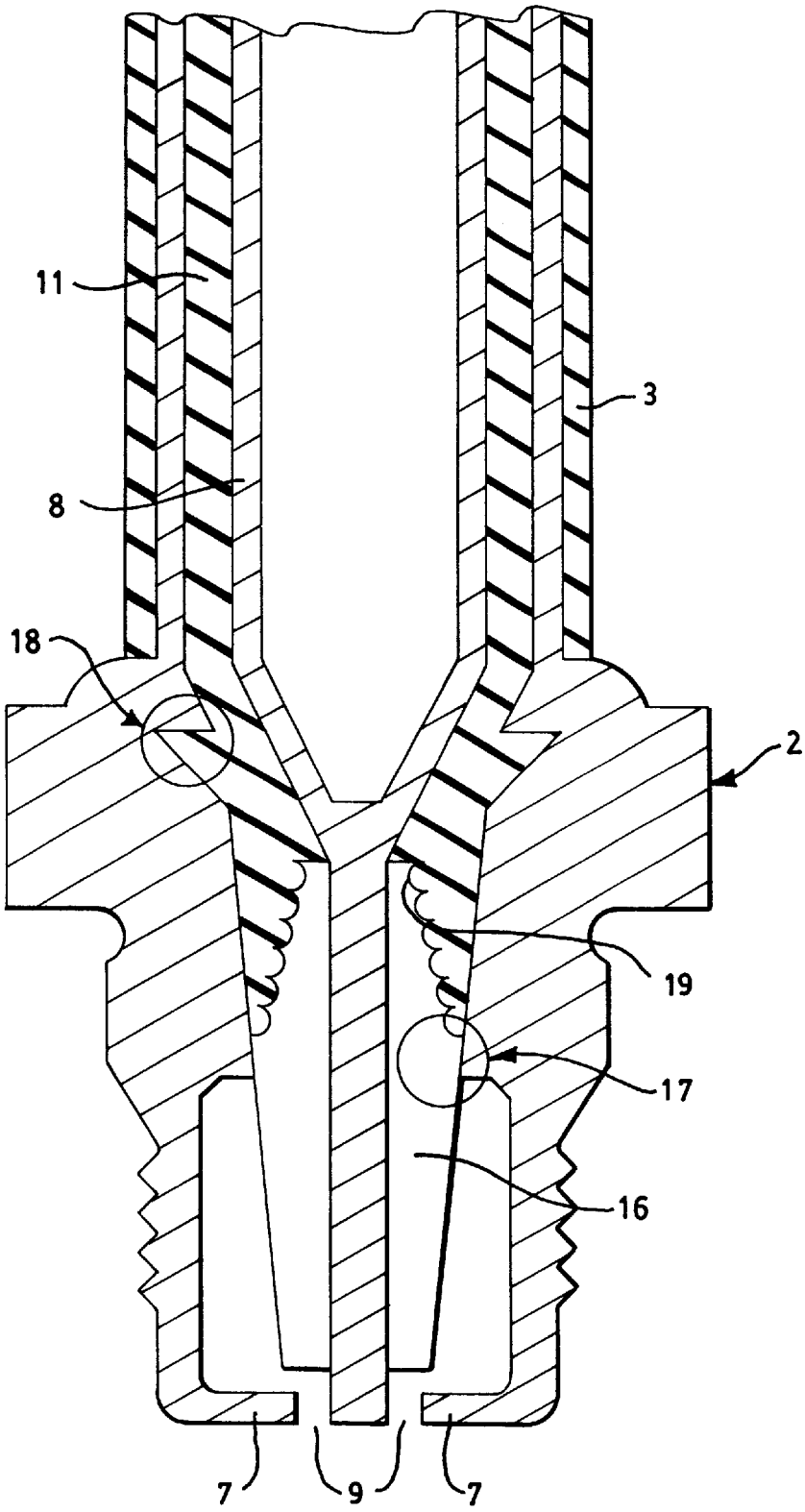
FIG. 6. shows an alternate embodiment of the invention providing a ceramic cone which encases the positive electrode in the combustion chamber.

FIG. 6 illustrates the use of a ceramic cone 16 to shield the dielectric insulation 11 from the high temperatures and oxidizing conditions inside the combustion chamber. The Figure also illustrates an alternative design for the positive electrode 8 which is comprised of both hollow and solid sections. Also illustrated are details of preferable means to achieve a stable mechanical connection between the dielectric insulation 11 and both the cone 16 and the body 2.

Dielectric insulation 11 suitable for use in the present invention generally is able to withstand the high temperatures present in the combustion chamber. However, such materials often degrade when exposed to the flame of combustion. Typically, the insulation material will char on the surface and provide a path for the spark to bypass the negative electrode and travel to ground by tracking along the charred surface. To prevent this result, it is desirable to employ a prefabricated ceramic cone 16, which receives the positive electrode 8 and is inserted into the body 2. As can be seen by reference to FIG. 6, once so positioned, the ceramic cone shields the dielectric insulation from the flame of combustion.

In manufacture, the ceramic cone 16 is fitted into a tapered seat 17 in the body 2 and the positive electrode 8 is inserted into the cone. The assembly is then injected molded with the dielectric insulation 11. The tapered seat 17 prevents the injected internal components of the invention from falling into the combustion chamber. Conversely, to prevent the internal components of the invention from being ejected from the body 2 during the high pressures of combustion, a retaining backcut 18, in the body may be utilized. The backcut or indent can have a pointed shoulder, as illustrated, or have a round or oval shape, so long as it is sufficient to restrict the backward movement of the ceramic cone 16 and positive electrode 8 during the high pressures of the combustion process. It also is desirable to provide means for a mechanical connection between the ceramic cone 16 and the dielectric insulation 11. It is particularly desirable to employ a series of conical ridges 19, however, alternative mechanical connections well known in the art may also be used.

FIG. 6 also illustrates the construction of the positive electrode 8 employing a hollow section. This section can be of any highly conductive material such as steel, iron, copper, or other materials as is known in the sparkplug art. The section of the positive electrode 8 which is received by the ceramic cone 16 is solid in construction and fashioned from a material of better than average conductivity, such as copper or other material commonly employed in the manufacture of sparkplugs.

The embodiment of a current peaking sparkplug disclosed above is considered to be the best mode of practicing the invention. However, it is recognized that alternative embodiments of the invention may be desirable in applications where a more compact sparkplug is called for, particularly for multi-valve cylinder heads where physical space often is very limited. In cramped physical spaces, it further is desirable to provide means for the attachment of the high-voltage ignition cable to the positive electrode inside the capacitive element, which also offers the advantage of reducing any RFI or electromagnetic emissions from the sparkplug. It some applications it is desirable to provide for an installation hex as far removed from the cylinder head as possible, so as to ease installation of the sparkplug and eliminate the need for special tooling. It also is desirable to provide a sparkplug with multiple positive and negative capacitive plates. This capability is essential to accommodate future developments in ignition systems. The presently preferred embodiment discussed above provides between 80 to 120 picofarads of capacitance, which electrically matches current ignition offerings from manufacturers and after market suppliers. The development by these companies of future, higher energy ignition systems will require sparkplugs of increased capacitance to retain high electrical transfer efficiency while at the same time retaining physical size.

Figure 7:
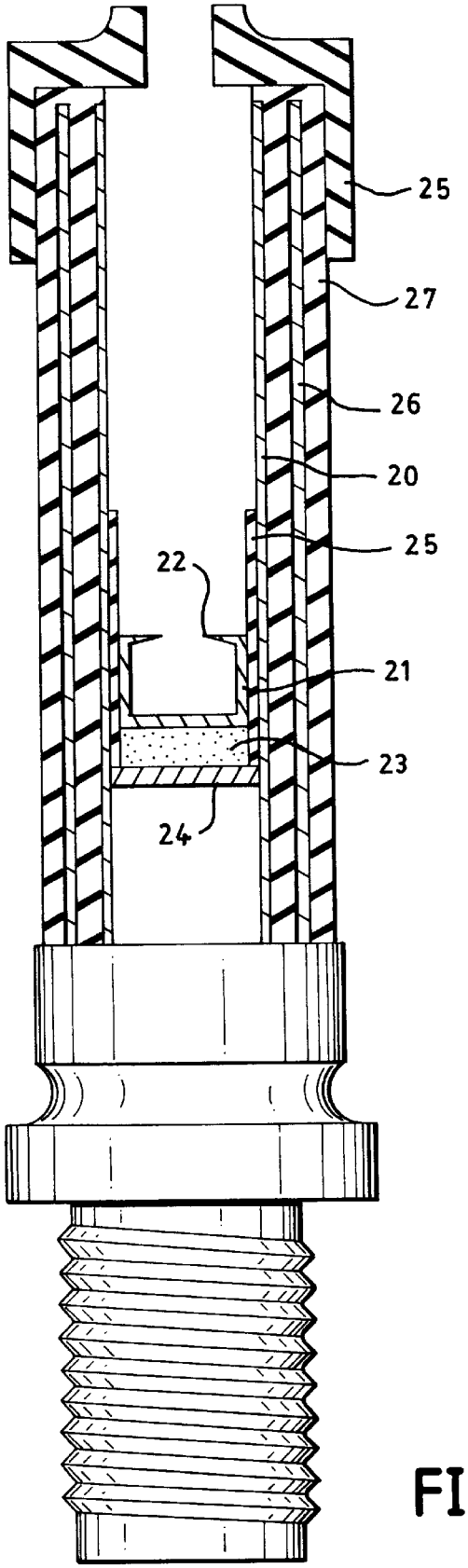
FIG. 7 shows a longitudinal partial cross section of an alternative embodiment of the invention and one means to connect the high-voltage ignition cable to the positive electrode within the capacitive element.
Figure 8:
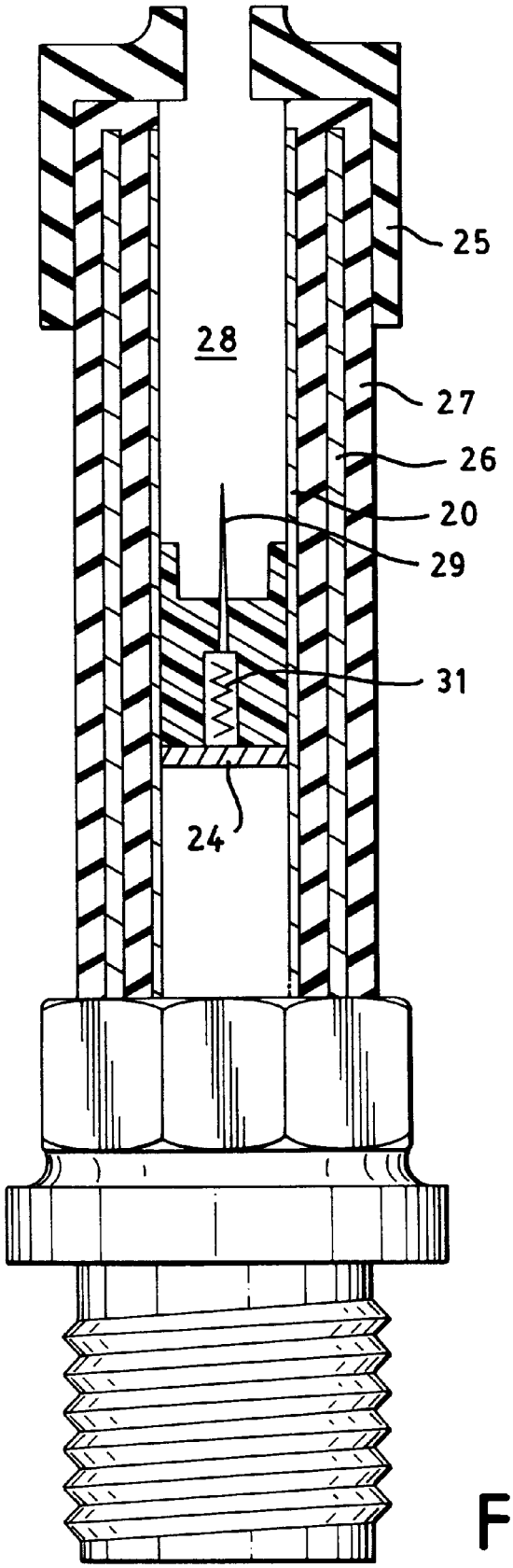
FIG. 8 shows a longitudinal partial cross section of the embodiment illustrated in FIG. 7 with an alterative means to connect the high-voltage ignition cable to the positive electrode within the capacitive element.
Figure 9:
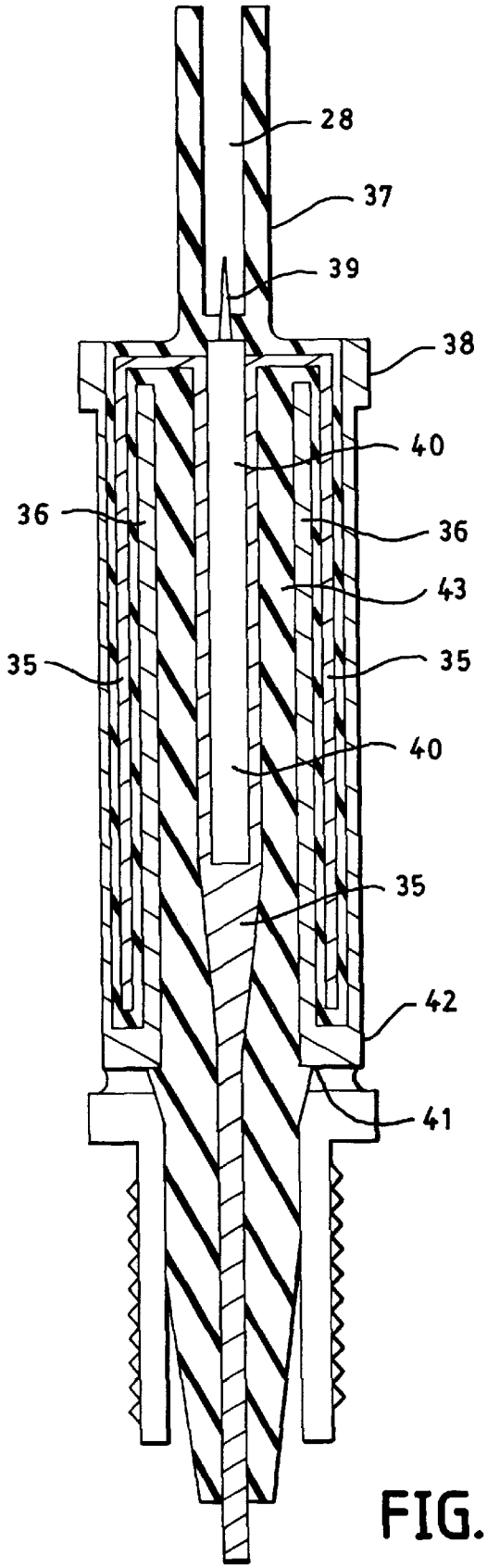
FIG. 9 shows a longitudinal cross section of yet another embodiment of the invention, one that provides two sets of opposing positive and negative plates to reduce the height of the sparkplug and to enable the use of higher spark energies, and that offers an alternative location of the installation hex for tightening the sparkplug to the cylinder head.
Figure 10:
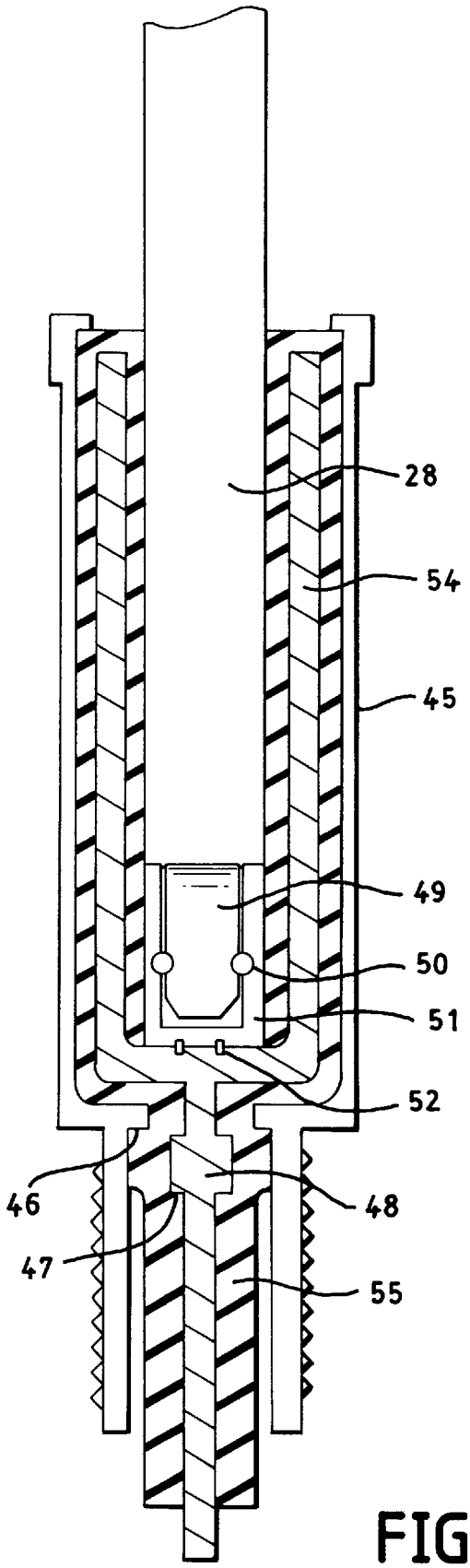
FIG. 10 shows a longitudinal cross section of a final embodiment of the invention, showing a wide, reduced height sparkplug and a connection between the high-voltage ignition cable and the positive plate where such connection is totally surrounded by ground to eliminate RFI emanations.

FIGS. 7 through 10 each illustrate alternative embodiments of the current peaking sparkplug invention to provide these enhancements. FIG. 7 discloses a compact sparkplug with one means for the attachment of the high-voltage ignition cable to the positive electrode inside the capacitive element. FIG. 8 discloses a similar compact sparkplug with alternative means for the attachment of the high-voltage ignition cable to the positive electrode inside the capacitive element. FIG. 9 discloses an even more compact sparkplug with multiple positive and negative capacitive plates, which is capable of delivering extremely high spark energies. FIG. 10 discloses a very compact sparkplug, one which can be physically smaller than conventional sparkplugs, that is particularly useful for restricted physical spaces. FIG. 10 also discloses another means for the attachment of the high-voltage ignition cable to the positive electrode inside the capacitive element and means to shield the connection so as to reduce RFI or electromagnetic emissions to a minimum. FIGS. 9 and 10 disclose alternative locations for installation hexes.

It should be understood that each of the embodiments illustrated in FIGS. 7 through 10 include bodies, threads, sparkgaps, positive and negative electrodes, capacitive elements, and dielectric materials as discussed above for the preferred embodiment. For sake of clarity, such design elements are not repeated in the discussions below, but, a reader should consider the embodiments illustrated in FIGS. 7 through 10 as modifications to the preferred embodiment illustrated in FIGS. 1 through 6 and discussed above.

Referring to FIG. 7, the positive electrode 20 is cylindrical and open at the end, exposing a central cavity to allow for the insertion of a high-voltage ignition cable (not shown). Attached to the electrode 20 by conventional means is a clip 21 made of a conductive material with two or more spikes 22 to make electrical contact with the high-voltage cable. A 2,000–5,000 ohm resistor 23 is placed between the clip and a conductive connector 24 to capture the center conductor of the HV ignition cable. An insulator 25 is located as to insulate the electrode from clip 21 to avoid electrical connection there between until the electrical charge passes through the resistor 23. The connector 24 allows electrical connection of the resistor with electrode 20. Preventing moisture or other elements from entering the open cavity is a weather seal 25 tightly formed around the high-voltage ignition cable and outside diameter of the sparkplug. The resistor 23 may be constructed of a resistive material, as discussed above for resistive connector 4, or be a resistor wired between the clip 21 and the connector 24 by conventional means. Particularly desirable would be a clip, resistor, and connector molded as a single element. The negative plate 26 of the invention can be seen totally encapsulated be the dielectric insulating material 27.

It is desirable to connect the high-voltage ignition cable to the positive plate by means of a resistor in the range of 2,000–5,000 ohms. This assembly provides an electrical shield for any incidental radio frequency interference that may emanate from the connection of the ignition cable terminal to the positive plate. This resistor is essential in shunting the RFI emissions created during the spark event. This interference is an oscillating, positive-negative, frequency in the same band width as the operating frequency of engine management computer systems, and such interference will cause a malfunction of the computer if not eliminated, or shunted to ground at the source. It further is desirable to locate the ignition cable inside the capacitive elements, as this offers further protection to RFI emissions.

Referring now to FIG. 8, an alternative means of connecting the center electrode 20 and a high-voltage ignition cable 28 is shown. As in FIG.7, the positive electrode 20 of the invention is hollow and open at the end to allow for the insertion of the ignition cable 28. Attached to positive electrode 20 by conventional means is a non-conductive connector 30, which provides a conductive spike 29 that is connected by conventional means to a 2,000–5,000 ohm resistor 31. The resistor 31 is attached by conventional means to the connector 24 which is connected to the positive electrode 20. Preventing moisture or other elements from entering the open cavity is a weather seal 25 tightly formed around the ignition cable 28 and outside diameter of the invention. The negative plate 26 of the invention can be seen totally encapsulated be the dielectric insulating material 27.

Referring now to FIG. 9, the multiple positive plates 35 and negative plates 36 are shown in a relationship that provides significantly more opposing oppositely charged surfaces by which to enable the retention of capacitive electrical size while shortening the overall length of the invention for applications where physical size constraints are placed. Tower 37 is provided to prevent arcing over the installation hex 38, which allows for installation of the sparkplug to the cylinder head. Connection to the ignition cable 28 is provided by spike 39. This connection could alternatively be accomplished by means of a snap or ring connector, or other means common to the industry. Attached directly to the spike 39 is a 2,000–5,000 ohm resistive material 40 that connects the ignition cable 28 to the positive electrode 35. The dielectric insulating material 43 can be seen completely isolating the multiple positive plates 35 from the negative plates 36. The resistor 40 is attached to the positive electrode 35 by conventional means. Also illustrated is an interlock 41 which helps to secure the capacitive elements to the body 42, preventing movement or even ejection of the elements during the high pressures of the combustion process.

FIG. 10 illustrates another means to connect the ignition cable 28 to the positive electrode 54. A detent and ring clip retainer is shown at 50, which is used to secure the connector 49 to the retaining cup 51. The connector 49 may be constructed of a resistive material, as discussed above for resistive connector 4. The retaining cup 51 is shown attached to the positive electrode 54 by means of copper staples 52, providing both secure and conductive attachment. Any other conventional means of attaching cup 51 to the positive electrode 54 may be used. The dielectric material element 55 extends nearly the length of the sparkplug and separates the body of the sparkplug from the positive elements of the sparkplug.

FIG. 10 also illustrates an alternative means for the interlocking of the capacitive elements of the invention to the body of the sparkplug. The positive interlock can be seen as 46 and 47 whereby the combination of an expanded center electrode 48 with the intrusion of the body 45 serve to effectively lock the capacitive elements at the base of the sparkplug. The upper interlock 46 serves to restrict movement of the capacitive elements during the operation of the invention, maintaining the relationship of the positive plate to the negative plate, which serves to prevent operating losses due to changes in capacitance during the temperature changes resultant from operation.

Modifications may be made in the invention without departing from its spirit and purpose. Various such modifications have already been set forth and others will undoubtedly occur to one skilled in the art upon reading this specification. Accordingly, it is not intended that the invention shall be limited other than in the manner set forth in the claims which follow.

I claim:

1. A sparkplug for igniting fuel in an internal combustion engine cylinder comprising:

a. a generally cylindrical outer body of conductive material having an upper installation hexagonal section, a seat section adjacent said hexagonal section, and a threaded section as its lower portion so as to mate with a standard combustion cylinder head;

b. a positive electrode having a resistive connector at its upper end and located along the central axis of said outer body and having a generally cylindrical form and having an upper portion extending substantially above said body and extending through said body, terminating at a spark gap;

c. said threaded section of said body having at least one negative electrode attached at its lower end and extending toward said positive electrode leaving an adjustable spark gap therebetween;

d. a dielectric insulator separating said body and said positive electrode of any suitable insulating material, said insulator extending in length along said positive electrode to said resistive connector; and e. a capacitive element comprising a negative cylindrical plate and extending along and spaced from said positive electrode and being an extension of said outer body and situated within an outer insulator and spaced from said positive electrode by said dielectric insulator;

f. said dielectric insulation completely encasing said positive electrode with the exception of said spark gap and said resistive connector.

2. The sparkplug of claim 1 wherein said resistive connector is a solid connector.

3. The sparkplug of claim 1 wherein said resistive connector is a threaded post.

4. The sparkplug of claim 1 wherein there are at least two negative electrodes equally circumferentially spaced so as to produce a spark channel.

5. The sparkplug of claim 4 wherein said spark channel is rotated to a position about 90 degrees from the plane of the motion of the piston in said combustion cylinder.

6. The sparkplug of claim 1 wherein said dielectric insulation completely encases said negative cylindrical plate.

7. The sparkplug of claim 6 wherein the capacitance of said spark plug depends on the spacing distance between said negative plate and said positive electrode, the dielectric constant of the dielectric insulation, and the length of said negative plate.

8. The sparkplug of claim 7 wherein the overall length of said spark plug is determined by the length of said negative plate for a particular spacing and dielectric insulation.

9. The sparkplug of claim 6 wherein said dielectric material is derived from liquid crystal polymer.

10. The sparkplug of claim 6 wherein said dielectric material is Kapton™.

11. The sparkplug of claim 6 wherein said insulator material is conventional and a joint is obtained between said insulator material and said dielectric insulation.

12. The sparkplug of claim 1 wherein said resistive connector is a 2,000–5,000 ohm resistive connector and is attached at the upper end of said positive electrode for connection to the high voltage cable of the ignition system.

13. The sparkplug of claim 1 wherein the tip of said positive electrode as said spark gap is coated with a highly conductive material such as platinum.

14. The sparkplug of claim 1 wherein the portion of the dielectric insulation protruding into the combustion chamber is coated with a heat and flame resistant material, such as ceramic.

15. The sparkplug of claim 1 wherein said negative electrodes are equidistant from said positive electrode and terminate in and arc equal to the arc created by the circumference of said positive electrode.

16. The sparkplug of claim 15 wherein a negative electrode crown is employed to maintain a consistent spark gap with the tips of a positive electrode petal.

17. The sparkplug of claim 1 wherein a ceramic cone is employed to shield said dielectric insulation at its lower end from high temperatures and oxidizing conditions.

18. The sparkplug of claim 17 wherein said ceramic cone receives said positive electrode and is inserted into said body.

19. The sparkplug of claim 18 wherein said ceramic cone is fitted into a tapered seat in said body and said positive electrode is inserted into said cone so as to prevent the internal components of said spark plug from falling into said combustion chamber.

20. The sparkplug of claim 19 wherein said body has a retaining backcut or indent, said backcut or indent having a pointed shoulder or a round or oval shape sufficient to restrict backward movement of said ceramic cone and said positive electrode during the high pressure of the combustion process.

21. The sparkplug of claim 20 having means for a mechanical connection between said ceramic cone and said dielectric material.

22. The sparkplug of claim 21 wherein said mechanical connection employs a series of conical ridges.

23. The sparkplug of claim 17 wherein said positive electrode comprises a hollow upper section and a solid lower section to be received by said ceramic cone.

24. The sparkplug of claim 1 wherein said positive electrode is hollow and open at the upper end and having a central cavity so configured as to allow the insertion of a high-voltage ignition cable, a connector having an integral 2,000–5,000 ohm resistor, and means to capture the center conductor of said ignition cable and located near the lower end of said central cavity.

25. The sparkplug of claim 24 further comprising aweather seal surrounding said ignition cable and overlapping the outer top portion of said sparkplug.

26. The sparkplug of claim 25 further comprising a weather seal surrounding said ignition cable and overlapping the outer top portion of said sparkplug.

27. The sparkplug of claim 24 wherein said connector is located in the lower portion of said hollow electrode and having a conductive spike to connect with said center conductor of said ignition cable, and connected to a 2,000–5,000 ohm resistor, said connector being attached to said positive electrode.

28. A sparkplug for igniting fuel in an internal combustion engine comprising:

a. a generally cylindrical body of conductive material having an installation hexagonal section near the upper portion of the sparkplug, a cylindrical sidewall section extending downward to connect with a seat section and a threaded section for installation in a cylinder head, said cylindrical section serving as one negative capacitor plate, another negative capacitor plate being a cylinder spaced inwardly from said cylindrical sidewall section and attached thereto in the vicinity of said seal section;

b. an insulator element extending inward from the installation hexagonal section of the outer body and forming a cylindrical tower extending upward and so configured as to hold an end portion of an HV ignition cable;

c. an axially located positive conductor located substantially the length of the sparkplug forming a positive capacitor plate and extending outward, radially beneath said insulator element and then downward, forming a cylinder spaced between said negative capacitor plates by insulator material;

d. a second insulator element of dielectric insulating material extending substantially the length of the sparkplug and separating said positive conductor from the said inner negative plate, said second insulator also separating the outer negative plate from the outer cylindrical positive plate; and e. said axially located positive conductor having axial space in its upper portion containing a 2,000–5,000 ohm resistor with means for connecting said resistor with said ignition cable and means for electrically connecting with said positive conductor.

29. The sparkplug of claim 28 wherein the means for connecting the resistor to said ignition cable is a spike extending through the base of said insulative tower.

30. The sparkplug of claim 28 wherein said dielectric insulating element interlocks with the outer body to prevent destruction of the sparkplug by cylinder pressure.

31. A sparkplug for igniting fuel in an internal combustion engine comprising:

a. a generally cylindrical body of conductive material having an installation hexagonal section near the upper portion of the sparkplug, a cylindrical sidewall section extending downward to connect with a seat section and a threaded section for installation in a cylinder head, said cylindrical section serving as one negative capacitor plate;

b. a conductive center electrode formed in a cylindrical shape section within said cylindrical sidewall section of said body and acting as a positive capacitor plate, said center electrode forming a flat base section in the vicinity of said seal section of said body and a rod section extending from said base section axially downward to the lower end of said sparkplug;

c. an element of dielectric material separating said body and said center electrode for the entire length of said sparkplug and extending along an interior of said cylindrical shape section downward to said flat base section of said conductive center electrode, said dielectric material forming an axially located void of a diameter to receive an HV ignition cable; and d. means to retain said HV ignition cable and electrically connect said HV ignition cable with said center electrode;

e. said rod section of said center electrode having an expanded section located beneath an inwardly expanded section of said body so as to form an interlock to lock the capacitive elements at said lower end of said sparkplug.

32. The sparkplug of claim 31 wherein said means for retaining said HV ignition cable comprises a conductive retaining cup located at the base of said void in said dielectric material, said cup opening upward to receive said HV ignition cable and secured thereto by a conductive ring retainer within the sidewall of said cup, forming an electrical contact between said HV ignition cable and said cup, the base of said cup being electrically connected with said flat section of said center electrode by means of a staple.

33. A spark plug for igniting fuel in an internal combustion engine comprising:

a. a generally cylindrical body of conductive material having an installation hexagonal section extending downward to a seat section and then a threaded section for installation in a cylinder head;

b. a positive electrode located axially along the length of said sparkplug and being in cylindrical form along the upper portion, said cylindrical portion of the positive electrode acting as a positive capacitor plate; and c. means to electrically connect a HV ignition cable to said positive cylindrical plate comprising:

(1) a clip disposed near the end of said HV cable so as to make electrical contact with said HV ignition cable and electrically connected by a cylindrical connector to a 2–5K ohm resistor, the bottom of which is connected to a lateral connector plate;

(2) a cylindrical insulative element located along the inner wall of said cylindrical portion of said positive electrode and so positioned as to extend from a point above said clip to a point even with the lower end of said resistor;

(3) said lateral connector plate electrically connected with the lower end of said resistor and extending below said insulator to form electrical contact with said cylindrical wall of said positive electrode; and d. a dielectric material element separating said positive capacitor plate and said negative capacitor plate and surrounding said negative plate so as to form the outer surface of said sparkplug from the top to the hexagonal section of said body.

34. The spark plug of claim 33 wherein said means to electrically connect said HV ignition cable to said positive cylindrical plate comprise:

a. a cylindrical, nonconductive connector element located at a point along said positive cylindrical plate;

b. an electrically conductive spike mounted vertically in said connector so at to connect at its point with the conductive portion of said HV ignition cable at the end thereof, said spike being connected with said 2–5 K ohm resistor mounted axially within said connector; and c. an electrically conductive connector plate extending laterally beneath said connector and said resistor to form electrical contact with said cylindrical wall of said positive electrode.

* * * * *